US006234000B1

(12) United States Patent
Bowling

(10) Patent No.: US 6,234,000 B1
(45) Date of Patent: May 22, 2001

(54) BALL-BAT REPAIRING METHOD

(76) Inventor: Wiley L. Bowling, 5522 Sandpiper Ct., West Chester, OH (US) 45609

( * ) Notice: Subject to any disclaimer, the term of this patent is extended or adjusted under 35 U.S.C. 154(b) by 0 days.

(21) Appl. No.: 09/399,257

(22) Filed: Sep. 20, 1999

(51) Int. Cl.[7] ..... B21D 3/16

(52) U.S. Cl. ..... 72/370.23; 72/367.1; 72/454; 72/466.8; 72/416; 29/402.19

(58) Field of Search ..... 72/416, 367.1, 72/370.23, 454, 465.1, 466, 466.6, 466.8, 54, 57; 29/402.19, 402.01; 269/274, 275; 473/566, 564

(56) References Cited

U.S. PATENT DOCUMENTS

| | | | | |
|---|---|---|---|---|
| 242,950 | * | 6/1881 | Mackinnon | 72/454 |
| 429,701 | * | 6/1890 | Parmelee | 72/454 |
| 856,074 | * | 6/1907 | Lockhart | 269/274 |
| 1,098,408 | * | 6/1914 | Rorive | 72/454 |
| 2,202,125 | | 5/1940 | Temple, Jr. . | |
| 2,288,158 | * | 6/1942 | Ellinwood | 269/275 |
| 2,356,318 | * | 8/1944 | Hayman | 269/275 |
| 2,793,859 | * | 5/1957 | Darling | 473/564 |
| 2,800,867 | * | 7/1957 | Smith | 72/454 |
| 3,301,035 | * | 1/1967 | Gill | 72/404 |
| 3,373,987 | * | 3/1968 | Herrington | 269/275 |
| 3,564,884 | * | 2/1971 | Hinshaw | 72/57 |
| 3,568,496 | * | 3/1971 | Burke | 72/404 |
| 3,576,122 | * | 4/1971 | Churla | 72/57 |
| 4,036,044 | | 7/1977 | Yoshimura | 72/81 |
| 4,038,850 | | 8/1977 | Sakagami | 72/367 |
| 4,116,037 | * | 9/1978 | Honeycutt | 72/409 |
| 5,257,525 | * | 11/1993 | Clarke | 72/454 |
| 6,056,655 | * | 5/2000 | Feeney | 473/566 |

* cited by examiner

*Primary Examiner*—Daniel C. Crane
(74) *Attorney, Agent, or Firm*—Wood, Herron & Evans, LLP

(57) ABSTRACT

The present invention provides a ball-bat repairing apparatus to repair, for example, softball and baseball bats, in which particularly aluminum ball-bats which have been deformed from repeated use are returned to substantially their original diameter along the longitudinal extent of the ball-bat barrel. The ball-bat repairing apparatus has a frame which holds a two-piece die therein. The two-piece die has a top half and a bottom half in which a pair of semi-cylindrical die inserts are secured. The die inserts are made of relatively soft material, e.g., plastic so as not to damage the aluminum bat during repair. A compression member is threadedly received through the frame and is located in mechanical cooperation with a first of the die halves. When a ball-bat is placed within the die so that the damaged portion of the barrel is positioned between the die insert halves, a user compresses the deformed portion of the ball-bat between the first and second die inserts to substantially return the ball-bat barrel to its original diameter.

6 Claims, 4 Drawing Sheets

BALL-BAT REPAIRING METHOD

FIELD OF THE INVENTION

This invention relates to ball-bats. More specifically, this invention relates to a ball-bat repairing apparatus and method of use.

BACKGROUND OF THE INVENTION

Traditionally, sports involving the use of ball-bats, e.g., baseball and softball, use wooden bats made of ash or other hard woods. These wooden bats are expensive, time consuming to manufacture, and once broken cannot be satisfactorily repaired to be put back into effective use. So, over time, a metal, and usually aluminum, ball-bat was introduced into baseball and softball as a substitute for the traditional wooden bat because it was relatively inexpensive to manufacture and had a much longer useful life than a wooden bat. In fact, even when slightly deformed through repeated impacts with a baseball or softball, an aluminum bat can still be used. However, even an aluminum bat is generally thought of as having a finite useful life until the aluminum bat becomes so deformed, for example, even taking on triangular or square shapes of deformation, the aluminum bat must be retired. Once an aluminum becomes deformed to this extent it can simply not be effectively used to swing at and strike a ball to achieve desired results.

Use of aluminum bats reaches from little league softball and baseball, to collegiate use, to professional softball and to use in international amateur sporting events. About the only sporting teams regularly using traditional wooden bats are those playing professional baseball. So, manufacture, sale and use of aluminum bats far outpaces wooden bats.

Most aluminum bats are generally less expensive use than wooden bats there are softball and baseball teams that simply cannot afford to replace deformed aluminum bats as often as needed. Little league baseball and softball teams in economically disadvantaged areas often cannot afford to replace old and worn-out equipment, even equipment as integral to softball and baseball games as the aluminum bat itself. Furthermore, it has become commonplace for high school and even collegiate athletic programs that have become short of funding for their teams to be forced to cut costs by not only keeping old and deformed aluminum bats in softball and baseball rotation, but even cutting funding for entire sports teams.

Of course, old aluminum bats that should have been long since retired from use do not simply represent an economic burden on those little league, high school, and collegiate teams, et al., who cannot afford new bats, but also those deformed aluminum bats are still used by those batters who are waiting for a perfect pitch and are thus placed at a serious competitive disadvantage when facing teams with the funding to provide new equipment to its players. In order to, as nearly as possible, allow equally talented teams compete on equal footing it would be a great advance to enable all teams to perform on the playing field with equally sound equipment.

On the other hand, contemporary aluminum bats and bats made of other non-wood materials can be very expensive and very costly to replace regardless of who the purchaser may be. One example of such a contemporary bat is seen in U.S. Pat. No. 5,676,610 on a bat having a rolled sheet of resilient material inserted into the barrel. This type of bat has a relatively thin metal barrel and, while the resilient insert is intended to spring the barrel back after an impact, is more easily deformed by the impacts caused when, for example, a professional softball player hits a home run.

OBJECTIVES OF THE PRESENT INVENTION

Therefore, it is a first objective of the present invention to provide a ball-bat repairing apparatus which repairs deformed non-wooden ball-bats.

It is another objective of the present invention to provide a ball-bat repairing apparatus that is relatively inexpensive and of durable construction.

It is a further objective of the present invention to provide a ball-bat repairing apparatus that will return a damaged metal ball-bat which has been deformed from its original barrel diameter back to the original barrel diameter without damaging the ball-bat.

It is yet another objective of the present invention to provide a method of repairing a non-wooden ball-bat having damaged portions along the longitudinal extent of the ball-bat barrel which deviate from the ball-bat barrel original diameter.

SUMMARY OF THE INVENTION

The objectives of the present invention are achieved by providing a ball-bat repairing apparatus and method of use in which a ball-bat having damaged portions with outwardly and inwardly deformed portions along the longitudinal extent of the ball-bat barrel is inserted into a generally cylindrical die housed within a frame, the die being compressable around the barrel to repair the barrel damage. The die is a two-part die with a first body half, a second body half and having a substantially cylindrical die insert diametrically cut so that first and second opposed die insert halves may be secured within respective first and second die body halves. The die insert is made from relatively soft material, e.g., plastic or other suitable material that does not damage the ball-bat during application of the present inventive method. The ball-bat repairing apparatus has a manually operable compression member threadedly received through the housing and received in mechanical cooperation with one of the die body halves to reciprocate the body halves together around a ball-bat barrel inserted within the die. The body halves are resiliently and continuously biased apart to allow a user to more easily relieve pressure from the barrel after barrel compression, as discussed below.

In the method of the present invention, a ball-bat barrel with a damaged portion having inwardly and outwardly deformed portions is inserted into the repairing apparatus, the damaged portion being positioned between the first and second insert halves with the outwardly deformed portion of the ball-bat vertically oriented within the die. The die insert has a diameter slightly larger than a ball-bat barrel so that the ball-bat barrel may be over-stressed during compression, as discussed below. After the damaged portion of the ball-bat barrel has been positioned between the first and second insert halves, the user reciprocates the compression member downwardly so that it exerts downward force upon the die with the ball-bat barrel positioned therein. The user compresses the die upon the ball-bat barrel so that the damaged portion of the barrel is compressed to about the original barrel diameter and then over-stressed to a diameter generally smaller than the barrel's original diameter in the vertical plane. Over-stressing the barrel in the vertical plane in which the outwardly deformed portion is oriented allows the barrel to slightly flatten within the die in the vertical plane. The user then decompresses the ball-bat barrel which rebounds from its over-stressed condition to about the barrel original diameter and then, as desired, rotationally index the barrel while maintaining the damaged portion within the die, for further repair. As desired, the user then recompresses the damaged area and over-stresses the damaged portion once again, thereafter decompressing the ball-bat barrel damaged portion.

Each time the ball-bat barrel is decompressed the barrel has a tendency to spring back to substantially the original barrel diameter from the barrel's over-stressed condition. The user performs the inventive method upon the ball-bat barrel damaged portion as many times as is desired in order to substantially return the damaged portion to the barrel original diameter.

As is desired, the user longitudinally indexes the ball-bat barrel through the die in order to repair other damaged portions along the ball-bat barrel's longitudinal extent by the inventive method described above.

The features and objectives of the present inventive ball-bat barrel repairing apparatus will become more readily apparent from the following Detailed Description taken in conjunction with the accompanying drawings.

DETAILED DESCRIPTION OF THE PREFERRED EMBODIMENT

Figure 1:
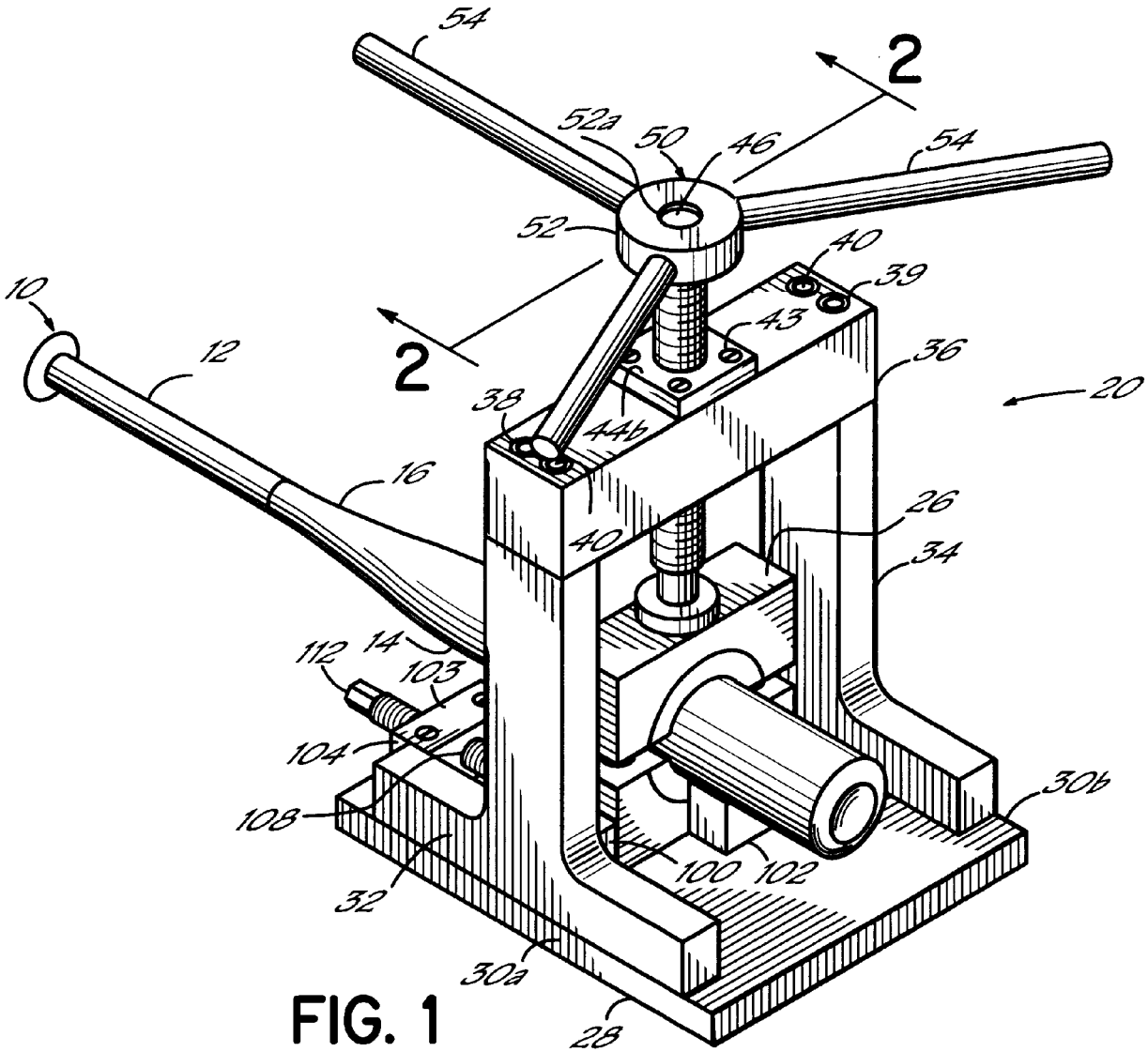
FIG. 1 is a perspective view of the present inventive ball-bat repairing apparatus.

As is seen generally in FIGS. 1–5, a ball-bat 10, e.g., a baseball or softball bat, has a handle 12 which a user grips, a barrel 14 with which the user strikes at a ball and a taper portion 16 generally forming a transition between the handle 12 and the barrel 14. As is often the case, the ball-bat 10 used by many sports teams are made of relatively thin walled aluminum or other deformable material which has a tendency to deform with repeated use from impacts with a softball or a baseball, resulting in a deformed ball-bat 10*a* having at least one damaged portion 11 with outwardly and inwardly deformed portions 11*a*, 11*b*. However, while the present invention and inventive method is described herein with reference to an aluminum ball-bat 10, it will be understood that any non-wood ball-bat may be repaired with the present invention and method of use. Prior to deformation, a ball-bat 10 has an original exterior diameter 18*a*. By way of example only, the original diameter 18*a* of a typical softball bat is in the range of about 2.25 to about 2.28 inches.

Figure 3:
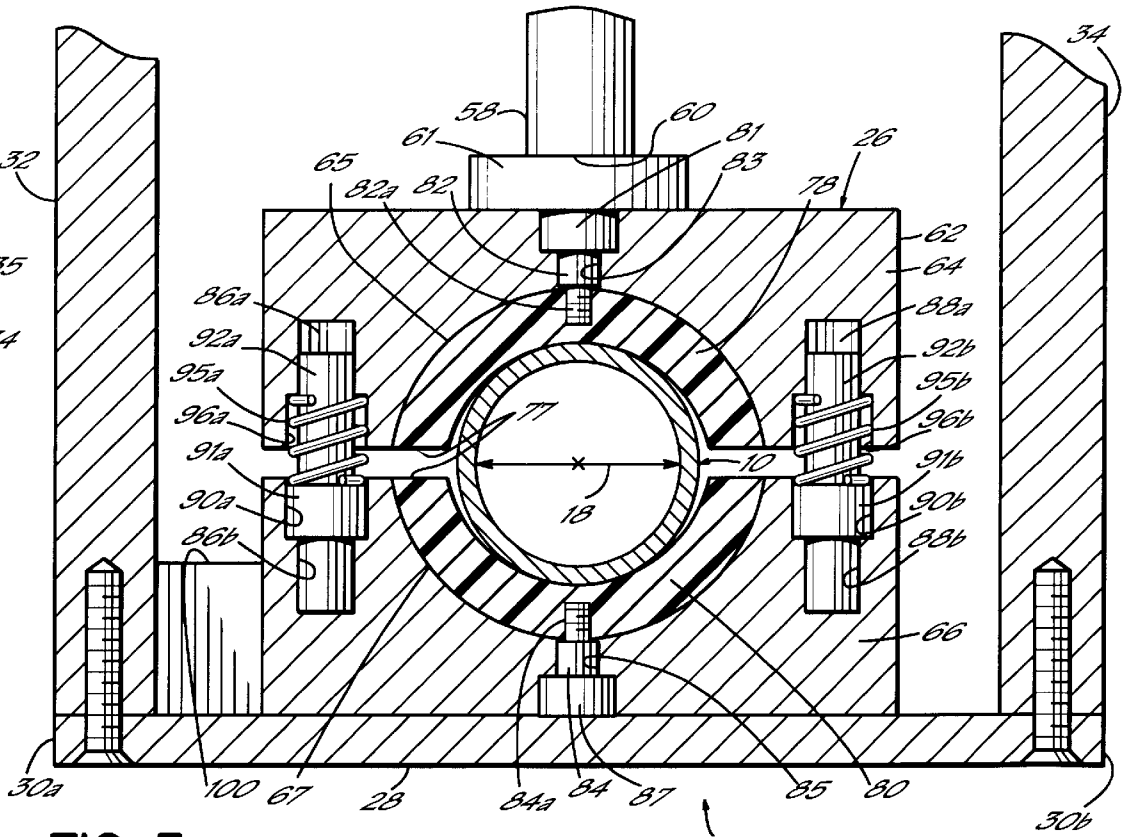
FIG. 3 is a close-up of the cross-sectional view of FIG. 2.
Figure 2:
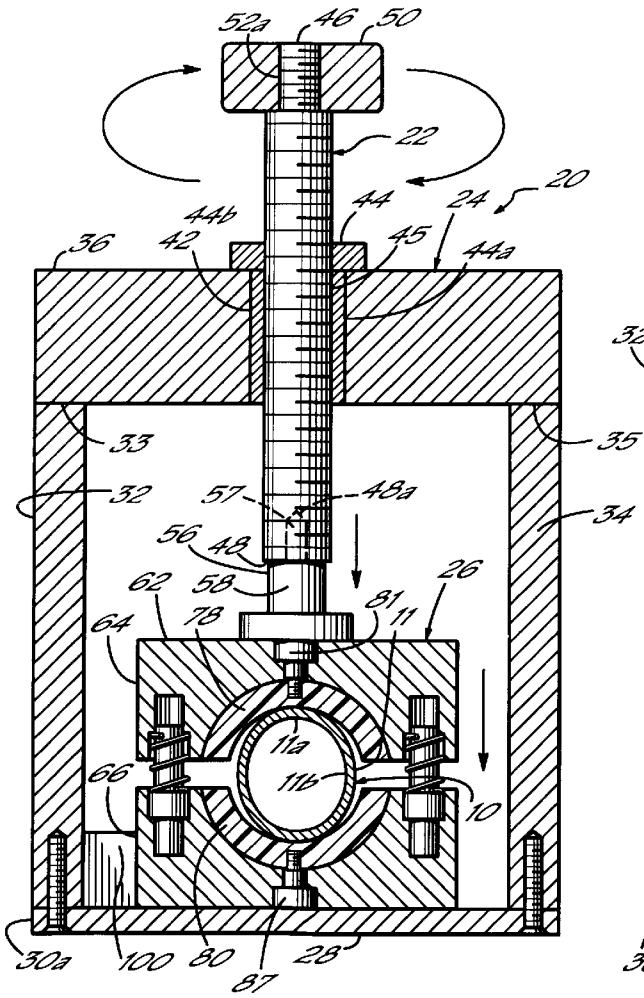
FIG. 2 is a cross-sectional view of FIG. 1 taken along line 2—2.

A first presently preferred embodiment of a ball-bat repairing apparatus 20 is seen in FIGS. 1–3. The repairing apparatus 20 will be described herein with reference to repairing an aluminum softball bat, however, it will be understood that the repairing apparatus 20 may be used to repair other ball-bats having different original diameters in the present inventive method, as is further described below.

The repairing apparatus 20 generally has a compression member 22, a frame 24 and a die 26.

The frame 24 houses the die 26 and functions to stabilize the repairing apparatus 20 during reciprocation of the compression member 22 against the die 26. The frame 24 has a base 28 with opposite edges 30*a*, 30*b* proximate to which respective support members 32, 34 are secured by means generally known in the art. The support members 32, 34 have respective top surfaces 33, 35 upon which a bar 36 is received, spanning the distance between the support members 32, 34. The bar 36 has apertures 38, 39 defined therein, each receiving a nut 40 to be secured within respective axially aligned apertures (not shown) defined in each of the respective top surfaces 33, 35.

In the present preferred embodiment, each of the base 28, support members 32, 34, and bar 36, are made from 6061-T6 aluminum. However, the frame 24 may be made by any suitable material known in the art.

The bar 36 has an insert aperture 42 defined approximately medially along the longitudinal extent of the bar 36 therein. The insert aperture 42 is sized to receive a bearing insert 44 having a body 44*a* and a crown 44*b*. In the preferred embodiment, the bearing insert 44 is made of brass, however, any other suitable material may be used. The body 44*a* is received into the insert aperture 42, the outside diameter of the body 44*a* being substantially similar to the cross-sectional diameter of the insert aperture 42. The crown 44*b* is received against the bar 36. The bearing insert 44 is secured to the bar 36 with screws 43, however, the bearing insert 44 may be secured to the bar 36 by any other suitable means.

The bearing insert 44 defines a threaded aperture 45 which threadedly receives the compression member 22 therein. In the presently preferred embodiment, the compression member 22 is a steel acme threaded screw having a first end 46 and a second end 48. The first end 46 of the compression member 22 threadedly receives a handle assembly 50 thereon. The handle assembly 50 has a hub 52 defining a hub aperture 52*a* to receive the first end 46 of the compression member 22 therethrough. It will be understood that the hub 52 may be secured to the first end 46 by any other suitable means. The handle assembly 50 has a plurality of arms 54 extending radially from the hub 52 that a user may grasp when using the repairing apparatus 20 in the present inventive method, as described further below.

The second end 48 of the compression member 22 has a button aperture 48*a* defined therein to receive a bearing pin 56 having a button 57 and a head 58. The button 57 is received within the aperture 48*a* without being affixed thereto, to allow the compression member 22 to rotate upon the head 58 during use. The head 58 has a head surface 60 which is received against a bearing plate 61. The bearing plate 61 floats between the bearing pin 56 and the die 26 without being secured to the die 26 to prevent galling. In the present embodiment, the bearing pin 56 and the bearing plate 61 are made of bronze or any other suitable material that will withstand the pressure created by the compression member 22 against the die 26, while not substantially marring the die 26, as is discussed further below.

The die 26 has a die body 62 with first and second die body halves 64, 66 with respective opposing semi-cylindrical first and second insert beds 65, 67, as best seen in FIGS. 2 and 3. Each insert bed 65, 67 receives a respective semi-cylindrical die insert half 78, 80 fixedly secured therein. In the present embodiment, the die insert halves 78, 80 are formed from a single cylindrical die insert (not shown) made of a relatively soft material, e.g., Teflon, Ertylite, Ultra High Molecular Weight thermoplastic material known in the art, or any other suitable material, which will not damage a bat barrel 14 when the repairing apparatus 20 is in use. The die insert has a cylindrical bore with an inner diameter of about 2.53 inches, which is about 0.03 inches larger than the bat barrel 14 used to describe the invention herein. The die insert cylindrical bore inner diameter is varied depending upon the original diameter 18*a* of the barrel 14 to be repaired. The die insert is divided approximately in half with a diametrical cut 77 of about 0.25 inches to form the first and second die insert halves 78, 80. In the preferred embodiment, the diametrical cut 77 made in the die insert is about 0.25 inches in width so that the first and second die insert halves 78, 80, when secured in respective first and second body halves 64, 66 allow a ball-bat 10 to be inserted therebetween to be compressed vertically smaller than its original diameter 18*a* during repair by the method of the present invention thereby over-stressing the barrel 14, as is further discussed below.

The first die insert half 78 is secured to the first body half 64 with a first lock screw 82. The first lock screw 82 is recieved into a screw aperture 83 defined in the first body half 64. The first lock screw 82 has a threaded end 82*a* which is threadedly engaged with the first die insert half 78. A cap 81 is placed in the screw aperture 83 above the screw 82. The second die insert half 80 is secured within the second body half 66 by a second lock screw 84 having a threaded end 84*a*. A cap 87 is placed in a screw aperture 85 below the screw 84. The threaded end 84*a* is threadedly engaged with the second insert half 80.

The first body half 64 defines first and second tracks 86*a*, 88*a* which are coaxially aligned with respective first and second tracks 86*b*, 88*b*, defined in the second body half 66. The first and second tracks 86*a*, 88*a* define respective bushing seats 90*a*, 90*b* in which respective bushings 91*a*, 91*b* are fixed. Track pins 92*a*, 92*b* are fixed by respective bushings 91*a*, 91*b* and extend between the first and second die body halves 64, 66 to maintain the first and second die body halves 64, 66 within substantially fixed vertical and horizontal alignment during use. Each track pin 92*a*, 92*b* is surrounded by a resilient member, e.g., coil springs 95*a*, 95*b* to continually urge apart the first and second die body halves 64, 66. The coil springs 95*a*, 95*b* are received within spring seats 96*a*, 96*b* defined in the second die body half 66. The track pins 92*a*, 92*b* allow the first die body half 64 and second die body half 66 to be vertically reciprocated so that the first and second die insert halves 78, 80 may be alternatively moved towards and away from one another to help prevent relative horizontal movement of the first and second body halves 64, 66 of the repairing apparatus 20 during use.

A pair of stabilization members 100, 102 are attached to the base 28 in order to locate the die 26 within the frame 24. The stabilization member 100 is fixed at a ninety degree angle relative to the stabilization member 102 to locate the die 26 on the centerline of the frame 24 with respect to the compression member 22. A vise block 103 is fixed to the base 28 and defines a threaded aperture 108 therethrough to receive a screw 112. The screw 112 has a die end (not shown) threaded into contact with the second die body half 66 to keep the die 26 locked in place during use. The vise block 103 is secured to the base 28 with screws 104.

Figure 5:
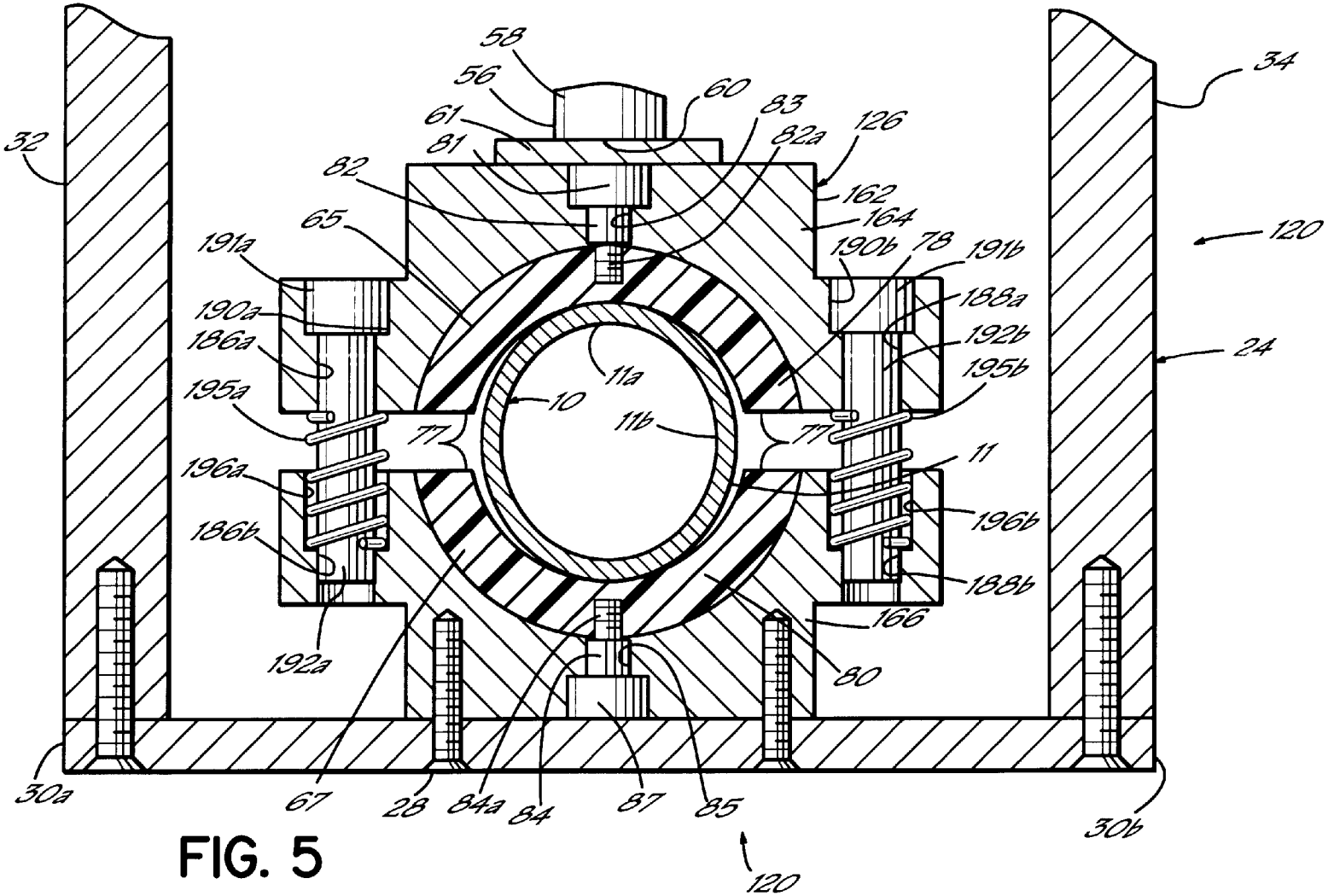
FIG. 5 is view similar to FIG. 3 showing an alternative embodiment of the repairing apparatus.

A second preferred embodiment of a repairing apparatus 120, is seen in FIG. 5. A die 126 has a die body 162 with first and second die body halves 164, 166. The first body half 164 defines first and second tracks 186*a*, 188*a* which are coaxially aligned with respective first and second tracks 186*b*, 188*b*, defined in the second body half 166. The first and second tracks 186*a*, 188*a* define respective bushing seats 190*a*, 190*b* in which respective bushings 191*a*, 191*b* are fixed. Track pins 192*a*, 192*b* are affixed to respective bushings 191*a*, 191*b* and extend between the first and second die body halves 164, 166 to maintain the first and second die body halves 164, 166 within a constant vertical and horizontal axial alignment during use. Each track pin 192*a*, 192*b* is surrounded by a respective resilient member, e.g., coil springs 195*a*, 195*b*, to continually urge apart the first and second die body halves 164, 166. The coil springs 195*a*, 195*b* are received within spring seats 196*a*, 196*b* defined in the first body half 164.

Figure 4A:
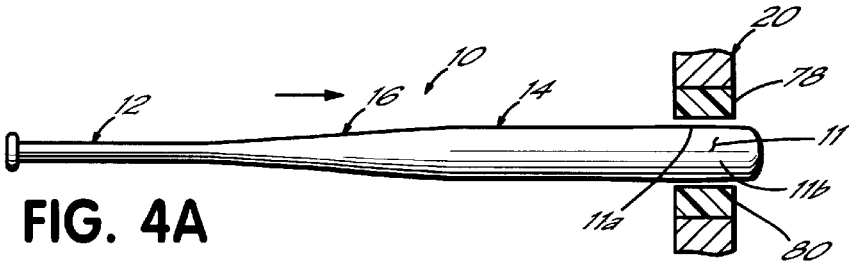
FIG. 4A is a side schematic view of a ball-bat being inserted into the present inventive repairing apparatus.
Figure 4B:
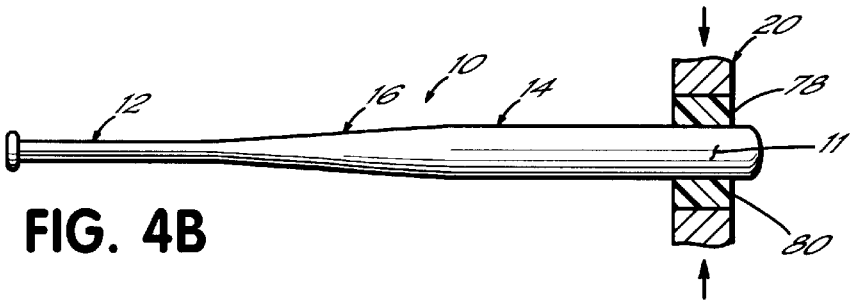
FIG. 4B is a similar view to FIG. 4A, with the ball-bat being repaired by the present inventive method.
Figure 4C:
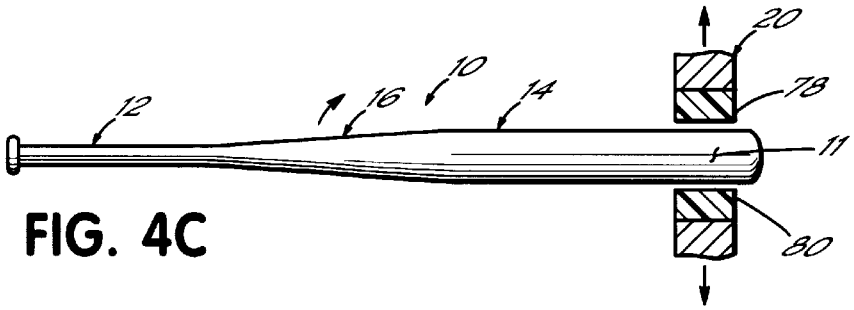
FIG. 4C is a view similar to FIG. 4A, with the ball-bat being repaired by the present inventive method.
Figure 4D:
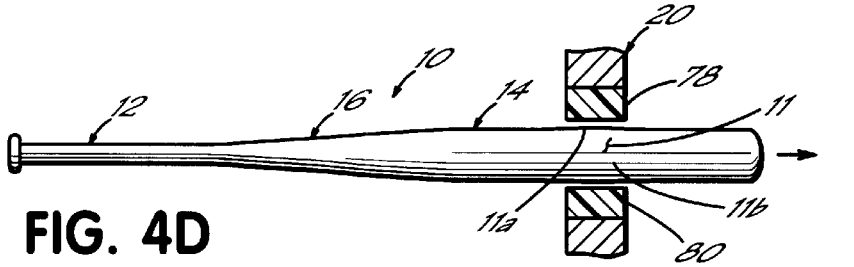
FIG. 4D is a similar view to FIG. 4A, with the ball-bat being repaired by the present inventive method.

In the present inventive method for repairing a ball-bat 10, a user first inserts the barrel 14 along the ball-bat longitudinal axis into the repairing apparatus 20 so that the damaged portion of the barrel 14 is positioned between the first and second die insert halves 78, 80, as seen in FIG. 4A. The damaged portion 11 of the barrel 14 generally has outwardly and inwardly deformed areas 11*a*, 11*b*, the outwardly deformed area 11*a* being positioned so that it is vertically oriented within the die 26 with respect to the first and second insert halves 78, 80.

A user then grasps the arms 54 of the handle 50 and turns the handle 50 so that the compression member 22 bears down against the bearing plate 61 (FIG. 2) attached to the die body first half 64. The movement of the first die body half 64 towards the second die body half 66 compresses the damaged portion 11 of the barrel 14 (FIG. 4B) under a load of about one to about three tons of pressure. As a user continues to exert pressure upon the barrel portion 14, the outwardly deformed portion 11*a* is forced inwardly to approach the original diameter 18*a*. Once the original diameter 18*a* is achieved, the user continues to apply force to the barrel 14 and deform the outwardly deformed portion 11*a* inwardly so that the damaged portion 11 in the vertical plane achieves a diameter smaller than the original diameter 18*a*. When the user thereafter decompresses the barrel 14 (FIGS. 3 and 4C), the damaged area 11 resiliently rebounds to substantially the original diameter 18*a*.

As a user desires, the damaged portion 11 of the barrel 14 is rotationally indexed (FIG. 4C) along the longitudinal axis of the barrel 14 a desired amount (about 15 to about 30 degrees in the present preferred embodiment), and, thereafter, the inventive method is performed upon the damaged portion 11 again. The present inventive method is repeated as many times as is desired upon the damaged portion 11 until a user is satisfied that both the inwardly and outwardly deformed portions 11*a*, 11*b* of the damaged portion 11 have been substantially returned to the original diameter 18*a* of the ball-bat 10.

Just as there are varying degrees of severity of damage that a user desires to repair by the present inventive method, the extent to which the inventive method is applied is entirely discretionary to a user. Of course, a ball-bat 10 may have more than one damaged portion 11 along the longitudinal extent of the barrel 14. Then, the user would longitudinally index (FIG. 4D) the ball-bat 10 through the die 26 and perform the inventive method as described above for each and every damaged portion 11 desired. The present inventive method is repeated as desired along the longitudinal extent of the barrel 14 until the ball-bat 10 substantially approximates the original diameter 18*a* of the barrel 14.

From the above disclosure of the detailed description of the present invention and the preceding summary of the preferred embodiment, those skilled in the art will comprehend the various modifications to which the present invention is susceptible. Therefore, I desire to be limited only by the scope of the following claims and equivalents thereof.

What is claimed is:

1. A method for repairing a damaged ball-bat having a barrel, with at least one damaged portion with outwardly and inwardly deformed portions, the damaged ball-bat having an original external diameter prior to deformation, said method comprising the steps of:

inserting the ball-bat barrel between first and second dies;

positioning the barrel so that the outwardly and inwardly deformed portions are located between said first and second dies;

moving at least one of said first and second dies towards the other of said first and second dies;

compressing the damaged portion of said barrel between said first and second dies; and decompressing the damaged portion of said barrel so that said barrel substantially conforms with the original external diameter of the ball-bat barrel prior to deformation.

2. The method of claim 1 comprising the steps of:

rotating the ball-bat about its longitudinal axis after said decompressing step; and performing said moving, applying and decompressing steps of claim 1.

3. The method of claim 1, wherein the method is performed for successive ball-bat barrel damaged portions along the longitudinal extent of the ball-bat barrel.

4. The method of claim 1, comprising the step of positioning the barrel so that the outwardly deformed portion is vertically oriented between said first and second dies.

5. A method of repairing a damaged ball-bat having a barrel, with outwardly and inwardly deformed portions, the damaged ball-bat having an original external diameter prior to deformation, said method comprising the steps of:

inserting the ball-bat barrel between at least first and second opposed dies;

positioning the barrel between said first and second dies so that the outwardly deformed area is vertically oriented with respect to said first and second dies;

moving at least one of said first and second opposed dies towards the other of said first and second dies;

compressing the deformed portion wherein one of said first and second dies forces the outwardly deformed area towards the other of said first and second dies;

deforming the damaged portion so that the outwardly deformed area is compressed inwardly in the barrel vertical plane so that said barrel achieves a diameter smaller than said original external diameter;

decompressing said damaged area so that said barrel rebounds to substantially said original diameter; and rotationally indexing said barrel about the longitudinal axis of said barrel a desired amount in order to perform the moving, compressing, deforming, and decompressing steps, as is desired.

6. The method of claim 5, wherein the method is performed for successive damaged portions along the longitudinal extent of the ball-bat, as is desired.

* * * * *

UNITED STATES PATENT AND TRADEMARK OFFICE

CERTIFICATE OF CORRECTION

PATENT NO. : 6,234,000 B1
DATED : May 22, 2001
INVENTOR(S) : Wiley L. Bowling

It is certified that error appears in the above-identified patent and that said Letters Patent is hereby corrected as shown below:

Column 1,
Line 24, after "aluminum", insert -- bat --.
Line 33, after "expensive", insert -- to --.
Line 34, after "bats", insert -- ; --.
Line 54, after "teams", insert -- to --.

Column 2,
Lines 26-27, "compressable" should be -- compressible --.

Column 3,
Line 36, after "is", insert -- a --.
Line 46, "are" should be -- is --.
Line 53, "is" should be -- are --.

Column 4,
Line 17, "by" should be -- of --.

Column 5,
Line 7, "inches" should be -- inch --.
Line 12, "inches" should be -- inch --.
Line 14, "inches" should be -- inch --.
Line 23, "recieved" should be -- received --.

Signed and Sealed this

Nineteenth Day of March, 2002

*Attest:*

*Attesting Officer*

JAMES E. ROGAN
*Director of the United States Patent and Trademark Office*